United States Patent [19]

Moore et al.

[11] 3,967,051

[45] June 29, 1976

[54] CAST RESIN CAPACITOR BUSHING HAVING SPACER MEMBERS BETWEEN THE CAPACITOR SECTIONS AND METHOD OF MAKING SAME

[75] Inventors: Curtis L. Moore, Sharon; Paul W. Martincic, Sharpsville, both of Pa.

[73] Assignee: Westinghouse Electric Corporation, Pittsburgh, Pa.

[22] Filed: May 22, 1975

[21] Appl. No.: 579,757

[52] U.S. Cl. ..... 174/143; 29/25.42; 29/631; 264/262

[51] Int. Cl.[2] ..... H01B 17/28

[58] Field of Search..... 174/73 R, 143; 317/242, 317/260; 29/25.42, 631; 264/262

[56] References Cited

UNITED STATES PATENTS

| | | | |
|---|---|---|---|
| 3,513,253 | 5/1970 | Woods | 174/143 |
| 3,769,446 | 10/1973 | Martincic et al. | 174/143 |
| 3,769,447 | 10/1973 | Quirk et al. | 174/143 |

FOREIGN PATENTS OR APPLICATIONS

| | | | |
|---|---|---|---|
| 251,617 | 5/1964 | Australia | 174/143 |
| 1,200,909 | 9/1965 | Germany | 174/143 |

*Primary Examiner*—Laramie E. Askin
*Attorney, Agent, or Firm*—D. R. Lackey

[57] ABSTRACT

A cast bushing having a capacitor structure which includes concentrically positioned capacitor sections. Each capacitor section includes a spacing member which helps to maintain the distance between the conducting portions of the capacitor sections during the casting process. The spacing members consist of a tapered cylindrical non-conductive mesh around which another mesh member and a conductive foil are positioned. The diameter of the smaller opening of the tapered mesh permits the insertion of a similarly constructed but smaller diameter capacitor section inside the tapered mesh to form concentric capacitor sections. The rigidity of the tapered portion of the mesh maintains the desired distance between the conducting foils of the two concentric capacitor sections. Two-piece mandrel assemblies are used to construct each capacitor section.

7 Claims, 3 Drawing Figures

CAST RESIN CAPACITOR BUSHING HAVING SPACER MEMBERS BETWEEN THE CAPACITOR SECTIONS AND METHOD OF MAKING SAME

BACKGROUND OF THE INVENTION

1. Field of the Invention

This invention relates, in general, to electrical bushings and, more specifically, to cast resin bushings having embedded capacitor sections.

2. Description of the Prior Art

Encapsulating a capacitor structure into a cast epoxy electrical bushing has been accomplished by several prior art arrangements. U.S. Pat. Nos. 3,513,253, 3,769,446 and 3,769,447, which are assigned to the assignee of this invention, teach encapsulating arrangements which are suitable for particular types of capacitor structures and bushing sizes. Briefly, such bushings have been constructed according to the prior art by placing the capacitor structure into a mold along with a suitable conductor stud. An epoxy resin is then injected into the mold and cured. The cylindrical capacitor sections of the capacitor structure are held in place by a suitable arrangement, such as by a fixture located at the ends of the capacitor sections or by special spacers located between the ends of concentric capacitor sections. While these methods are satisfactory for particular bushing types and sizes, certain types of capacitor structures cannot be properly embedded by these prior art techniques.

When the cylindrical capacitor sections are relatively long, the epoxy resin tends to distort the capacitor sections when the epoxy is being injected into the mold. The greatest distortion or displacement usually occurs near the axial center of the capacitor sections due to a lack of radial support in this region. Such displacement is usually greater when a non-porous capacitor section is used, such as one formed from a non-perforated metallic foil.

Therefore, it is desirable, and it is an object of this invention, to provide a bushing and a method of constructing the bushing wherein the center portions of the capacitor sections are not susceptible to distortion when the casting resin is injected into the mold.

SUMMARY OF THE INVENTION

There is disclosed herein a new and useful cast capacitor bushing which may be constructed without distortion of the capacitor sections during the casting process. Each capacitor section is constructed by winding a non-conductive mesh around a tapered mandrel. A sleeve is then positioned over the smaller end of the mandrel and over a portion of the non-conductive mesh wound thereon. Another sheet of non-conductive mesh is wound around the sleeve and the exposed portion of the previously wound mesh sheet. A conductive foil is wound around the outermost mesh and the assembly is heated to cure the resin which is on the foil and the mesh members. The two-piece mandrel is then removed from the rigid capacitor section which is assembled with similarly constructed but differently dimensioned capacitor sections to provide the complete capacitor structure. The capacitor structure is then placed into a suitable mold where the casting resin is forced around the capacitor structure and around the conductor stud of the bushing.

Capacitor sections constructed in this manner have a rigid mesh which tapers inwardly as a result of the taper on the forming mandrel. The tapered portion of the rigid mesh keeps the capacitor sections straight and separated from each other during the casting process. The tapered portion also provides sufficient electrical creep resistance along the filaments of the mesh to prevent electrical breakdown. The inside diameter at one end of this tapered portion is slightly larger than the outside diameter of the foil conductor of the capacitor section it surrounds. Thus, radial support for the concentric capacitor section is provided by the tapered portion of the mesh which extends between adjacent capacitor sections.

BRIEF DESCRIPTION OF THE DRAWING

Further advantages and uses of this invention will become more apparent when considered in view of the following detailed description and drawing, in which.

DESCRIPTION OF THE PREFERRED EMBODIMENTS

Figure 1:
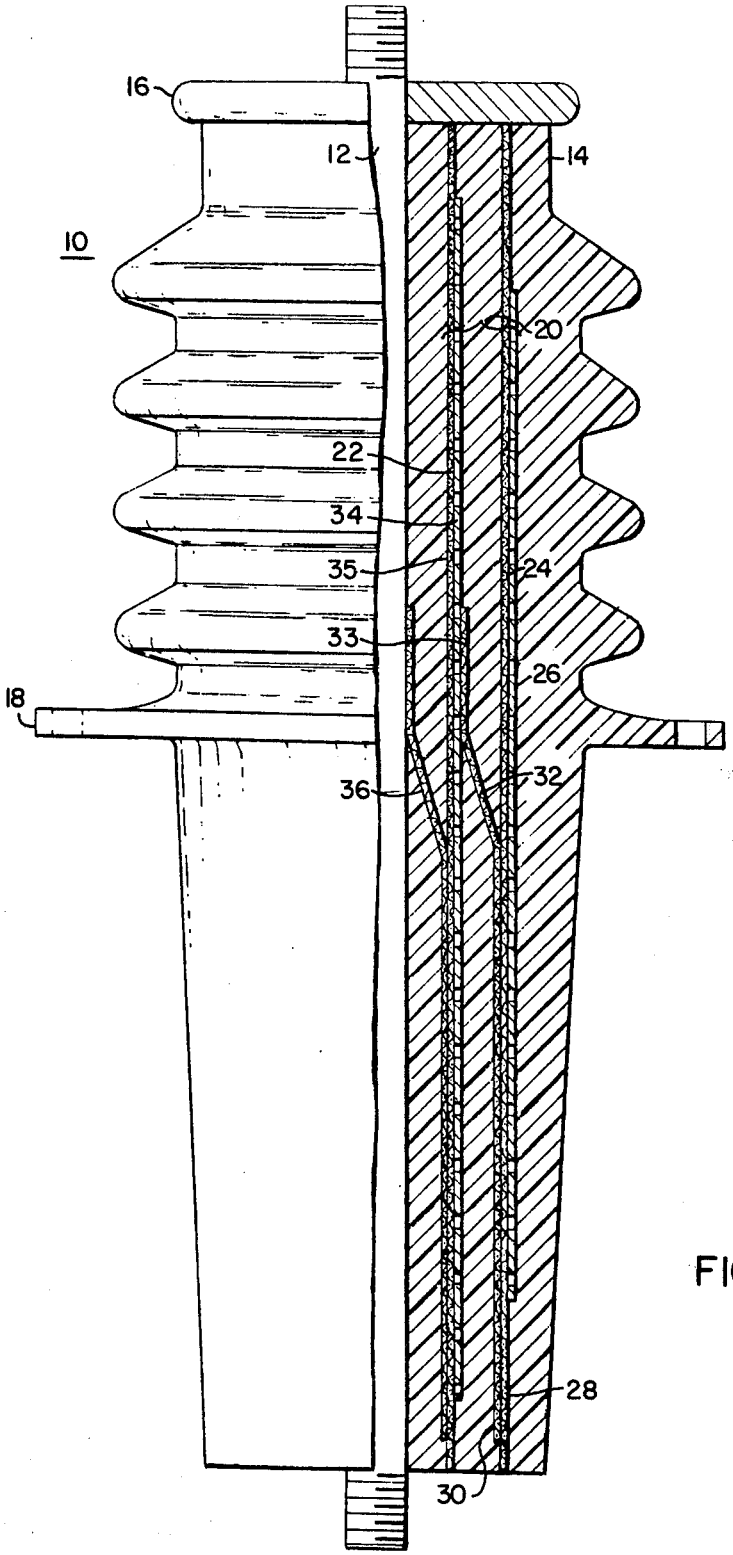
FIG. 1 is an elevational view of a bushing constructed according to this invention.

Throughout the following description, similar reference characters refer to similar elements or members in all of the figures of the drawing.

Referring now to the drawing, and to FIG. 1 in particular, there is shown a bushing 10 constructed according to a preferred embodiment of this invention. The bushing includes the conductor stud 12 and the bushing insulator 14 which is constructed of a suitable epoxy resin material. The bushing 10 also includes a cap and corona shield 16 located at an end of the conductor stud 12 and a flange 18 extending around the bushing insulator 14 which provides means for attaching the bushing 10 to the enclosure of the associated electrical apparatus.

The capacitor structure 20, which includes the capacitor sections 22 and 24, is embedded in the epoxy bushing insulator 14 as shown in FIG. 1. The capacitor sections are disposed concentrically around the conductor stud 12 and help to distribute the stress across the epoxy resin material of the bushing insulator 14. The capacitor sections 22 and 24 are constructed to each other except for some of the dimensions of the components of these capacitor sections.

The capacitor section 24 includes a conductive foil 26 which is disposed around a non-conductive mesh 28 to form a capacitor element. The conductive foil 26 and the mesh 28 extend around the conductor stud 12 in the form of a cylinder. Although it is not necessary for the proper electrical characteristics, the conductive foil 26 may contain small openings therein through which the epoxy insulating material may flow during the construction of the bushing 10. The mesh 28 extends to the ends of the bushing insulator 14 since, in the embodiment illustrated, the ends of the mesh 28 were held by the casting mold during the encapsulation process.

A non-conductive mesh 30 is located on the inside surface of the non-conductive mesh 28. The mesh 30 is substantially cylindrical along that portion of the mesh 30 which comes into contact with the non-conductive mesh 28. The tapered portion 32 of the non-conductive mesh 30 is connected to the cylindrical portion 33 of the mesh 30 which is located adjacent to the foil 34 of the capacitor section 22. The corresponding elements of the capacitor section 22, such as the mesh 35, are constructed to those of the capacitor section 24. In addition, more than two capacitor sections may be used in the bushing 10 without departing from the scope of the invention. The mesh member 30 exhibits an overall tapered cylindrical, or conical, shape. The axial lengths of the conductive foils 26 and 34 are different in order to provide the desired capacitance distribution to adequately distribute the stresses.

The non-conductive mesh members 28 and 30 are constructed of a suitable insulating material, such as a mesh of glass fibers coated with an epoxy resin. The porosity of the mesh members allows sufficient penetration by the epoxy to form a substantially voidless bond with the conductive foil 26. A suitable mesh is disclosed in U.S. Pat. No. 3,513,253.

The purpose of the tapered portions of the tapered cylindrical non-conductive mesh members 30 and 36 is to maintain the separation distance between the conductive elements of the capacitor sections and the conductor stud 12 during the construction of the bushing 10. The non-conductive mesh members 28, 30, 35 and 36 are treated prior to encapsulation to make them rigid for the purpose of maintaining the separation distances. A better understanding of the manner in which the conductive mesh members of the capacitor sections 22 and 24 maintain the desired separation distances may be realized from a description of a preferred method used for constructing the bushing 10.

Figure 2:
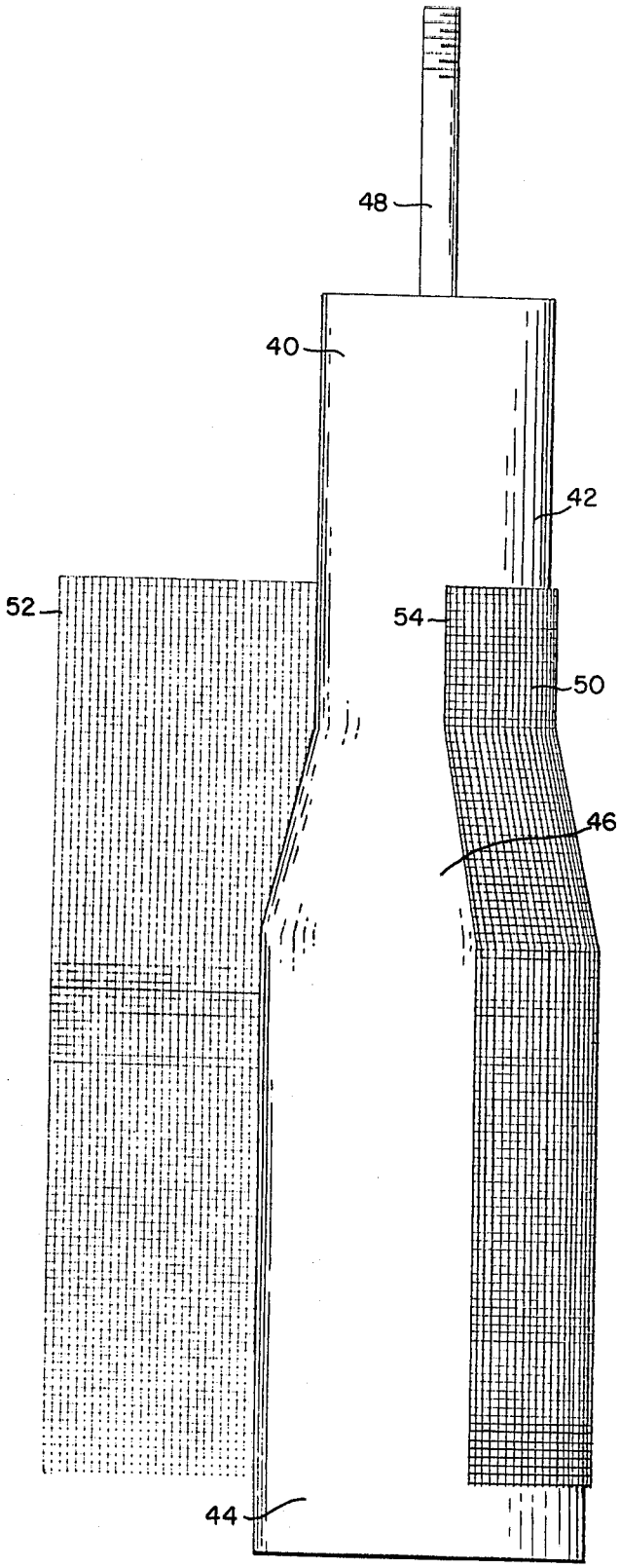
FIG. 2 is a view illustrating a step in the construction of the bushing shown in FIG. 1.

FIG. 2 is a view illustrating a step performed during the construction of the bushing 10. The mandrel 40 includes a cylindrical portion 42, a cylindrical portion 44 which has a larger outside diameter than the portion 42, and a tapered portion 46 which is located between the cylindrical portions 42 and 44. The mandrel 40 also includes a stud 48 which extends along the longitudinal axis of the mandrel 40. Although not shown in FIG. 2, a suitable releasing agent may cover the outside surface of the mandrel 40. A suitable material for this purpose has been found to be Teflon heat-shrinkable tubing which is telescoped over the mandrel and heated sufficiently to fit tightly around the mandrel 40.

The mesh member 50 is constructed of a suitable non-conductive material, such as glass filaments, with a B-stage epoxy resin coating thereon. When considering FIG. 2 as illustrative of the construction of the capacitor section 24 shown in FIG. 1, the mesh 50 and the mesh 30 are corresponding members. The mesh member 50 is wound around the mandrel 40 as indicated in FIG. 2. The view illustrated in FIG. 2 shows only approximately one-half of the mesh member 50 wrapped around the mandrel 40. In accordance with the complete process, the mesh member 50 will be wrapped around the mandrel 40 for at least one complete revolution with the end 52 of the mesh member 50 overlapping the end 54. Due to the tapered nature of the mandrel 40 and to the flexibility of the mesh member 50 before the resin thereon has been cured, the mesh 50 acquires, in general, a tapered cylindrical shape. Depending upon the actual process used, the mesh 50 can be wrapped around a stationary mandrel or wound on a revolving mandrel.

Figure 3:
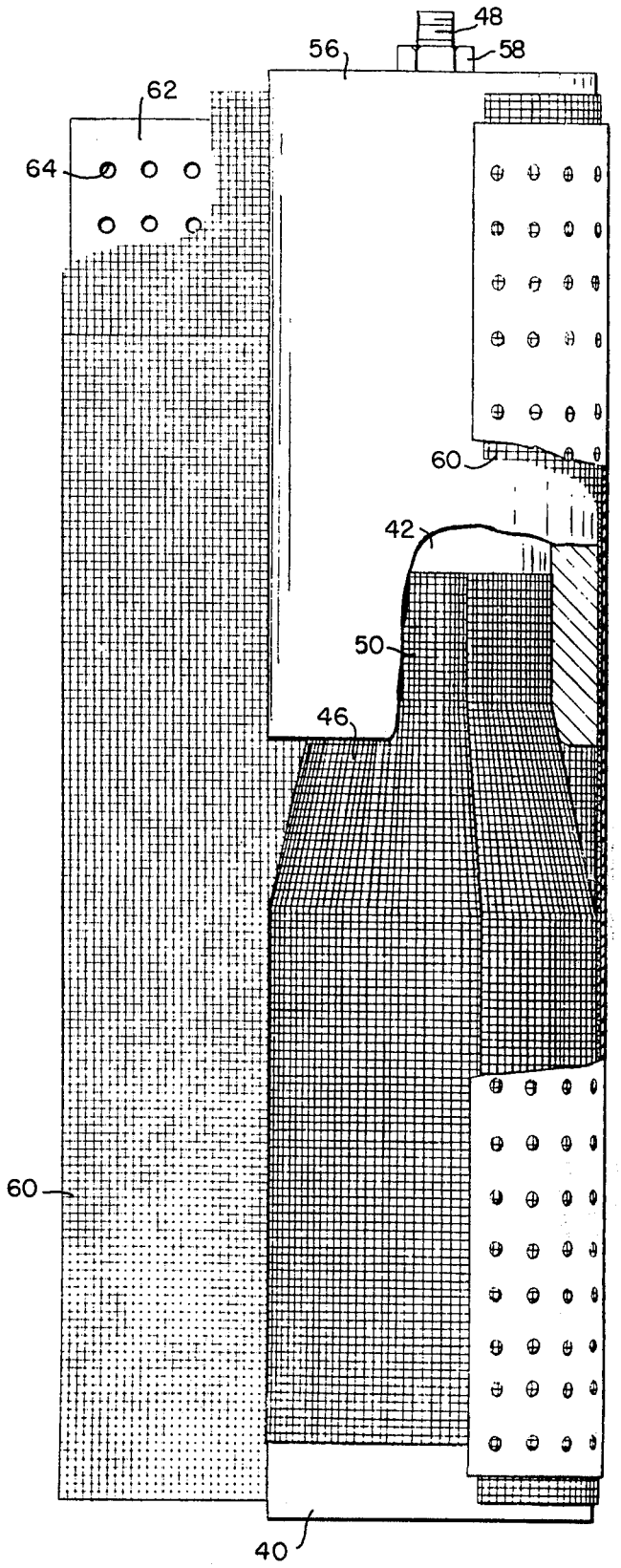
FIG. 3 is a view illustrating another step in the construction of the bushing shown in FIG. 1.

FIG. 3 illustrates a further step used in the construction of a capacitor section for the bushing shown in FIG. 1. After the mesh 50 has been wound around the mandrel 40, a sleeve 56 is positioned around the mandrel 40 and secured thereto by the nut 58. The inside diameter of the sleeve 56 is such that the portion of the mesh member 50 which is wound around the cylindrical portion 42 of the mandrel 40 is held against the mandrel. The outside diameter of the sleeve 56 is substantially equal to the outside diameter of the portion of the mesh 50 which is located around the larger diameter portion of the mandrel 40. Consequently, a substantially straight cylindrical surface extending for the entire length of the mandrel 40 is provided for the winding of the other members of the capacitor section.

After the sleeve 56 has been placed onto the mandrel 40, the mesh 60 is wound around the sleeve 56 and the mesh 50. The mesh 60 is constructed of a material similar to that of the mesh 50 and also contains a B-stage adhesive which is "tacky" during the winding stages of the construction but which may be cured later to form a rigid structure. Although indicated in FIG. 3 as being only partially wrapped around the mandrel 40 and the sleeve 56, the mesh 60 would normally extend for slightly more than one revolution around these members when the winding process has been completed. The foil 62, which contains openings such as the opening 64, is disposed around the mesh 60 to form the electrical portion, or the capacitor element, of the capacitor section. The foil 62 may be applied separately or at the same time as the mesh 60 without departing from the scope of this invention. Different types of capacitor elements may also be used, such as the electrical coating disclosed in U.S. Pat. No. 3,513,253.

After the assembly of the members shown in FIG. 3 has been completed, the entire assembly is heated to cure the adhesive which exists on the mesh members 50 and 60, and on the foil 62. Thus, these members form a rigid structure which is bonded together and which remains in such condition when the mandrel 40 and the sleeve 56 are removed therefrom.

Other capacitor sections are constructed in a similar manner, except that differences in the dimensions of the capacitor section members may exist. In general, when using a plurality of concentric capacitor sections, the inside diameter of the smaller cylindrical portion of the mesh member 50 is approximately the same diameter as the outside diameter of the foil in the capacitor section which is to be positioned within the mesh 50. Thus, after several capacitor sections of different diameters have been constructed according to the method illustrated in FIGS. 2 and 3, the capacitor sections may be telescoped concentrically with respect to each other to form a rigid structure which may be inserted into a suitable mold for encapsulation.

The rigid nature of the tapered portion of the conducting mesh 50 insures that the spacing between the conductive elements of the capacitor sections will be maintained during the encapsulation process. In addition to insuring adequate spacing between the capacitor conductive elements, capacitor sections constructed according to this invention can be encapsulated without the necessity of connecting the non-conductive mesh elements to the ends of the mold, as is illustrated by U.S. Pat. No. 3,513,253. To provide separation at the top and bottom of the capacitor structure, suitable spacers, such as the spacers 28 taught by U.S. Pat. No. 3,769,447, may be used. However, the bushing 10 of FIG. 1 is illustrative of a bushing constructed according to the method which uses a fixture to hold the mesh members at the ends of the mold.

The arrangement disclosed herein not only provides for maintaining the desired spacing distance between the capacitor conductive elements and between the innermost capacitor conductive element and the conductor stud, it also provides an arrangement for conveniently mounting the capacitor structure in the mold during the encapsulation process. Since the distance between the conductive elements of the capacitor sections is maintained by the rigid non-conductive mesh members located therebetween, epoxy injected into the mold will not cause the conductive elements of the capacitor to be distorted, even in bushings having relatively long capacitor sections. It is also within the scope of this invention that more than one tapered portion may be used between the capacitor sections. For example, with extremely long capacitor sections, instead of being placed substantially at one-half the distance from the top to the bottom, tapered sections may be placed at one-third and at two-thirds the distance from top to bottom. By using tapered instead of radial spacers, the creep and puncture distance between adjacent conductive elements is increased.

Since numerous changes may be made in the above-described apparatus, and since different embodiments of the invention may be made without departing from the spirit thereof, it is intended that all of the matter contained in the foregoing description, or shown in the accompanying drawing, shall be interpreted as illustrative rather than limiting.

We claim as our invention:

1. An electrical bushing comprising:

a current conducting structure;

a solid insulating material cast around the conducting structure;

a first cylindrical capacitor element concentrically located around the conducting structure and embedded in the solid insulating material;

a second cylindrical capacitor element concentrically located around the first capacitor element and embedded in the solid insulating material; and a spacing member constructed of a non-conductive material which is positioned between the first and second capacitor elements;

each of said capacitor elements including a conductive member and a non-conductive member;

said spacing member being constructed of a different material than said solid insulating material; and said spacing member having a conical portion which has a first diameter at one end and a second diameter at the other end, with the first diameter being substantially equal to the outside diameter of the first capacitor element and the second diameter being substantially equal to the inside diameter of the second capacitor element.

2. The electrical bushing of claim 1 wherein the spacing member comprises an open mesh constructed of a non-conductive material.

3. The electrical bushing of claim 1 wherein the end of the spacing member which has the first diameter is located generally at the axial middle of the first capacitor element.

4. The electrical bushing of claim 1 wherein the conductive members of the first and second capacitor elements comprise perforated metallic foil.

5. The electrical bushing of claim 1 including another spacing member constructed of a nonconductive material and positioned between the conducting structure and the first capacitor element, said last-mentioned spacing member being constructed of a different material than said solid insulating material, and said last-mentioned spacing member having a conical portion which has an opening at one end with a first diameter and an opening at the other end with a second diameter, with the first diameter being substantially equal to the outside diameter of the conducting structure and the second diameter being substantially equal to the inside diameter of the first capacitor element.

6. An electrical bushing comprising:

a current conducting structure;

an epoxy resin cast around the conducting structure;

a first metallic foil capacitor member attached to a first cylindrical non-conductive mesh and embedded in the epoxy resin concentrically around the conducting structure;

a second metallic foil capacitor member attached to a second cylindrical non-conductive mesh and embedded in the epoxy resin concentrically around the first capacitor member; and a mesh structure disposed between the first capacitor member and the second cylindrical mesh and constructed of a non-conductive material;

said mesh structure having a first cylindrical portion with a first diameter which is attached to the second mesh, and a second cylindrical portion with a second diameter which is attached to the first foil capacitor member, with said first diameter being larger than said second diameter, and with the cylindrical portions of the mesh structure being connected together by a frustoconically shaped portion.

7. A method of constructing a cast capacitor bushing comprising the steps of:

winding a first sheet of adhesive coated, non-conductive material around a tapered mandrel;

placing a sleeve around the smaller diameter portion of the tapered mandrel and the portion of the non-conductive material which is wound around the smaller diameter portion of the tapered mandrel;

winding a second sheet of adhesive coated, non-conductive material around the first sheet of adhesive coated, non-conductive material and said sleeve;

winding an adhesive coated, metallic foil around the second sheet of adhesive coated, non-conductive material;

curing the adhesive coating on the first and second sheets of non-conductive materials and on the metallic foil to provide a rigid capacitor section;

removing the sleeve from the mandrel;

removing the capacitor section from the mandrel;

assembling the capacitor section concentrically with other similar capacitor sections;

placing the capacitor sections into a mold and around a current conducting structure;

injecting an epoxy resin into the mold; and curing the epoxy resin.

* * * * *